US005328620A

United States Patent [19]

Ripple

[11] Patent Number: 5,328,620

[45] Date of Patent: Jul. 12, 1994

[54] OIL ADDITIVE PACKAGE USEFUL IN DIESEL ENGINE AND TRANSMISSION LUBRICANTS

[75] Inventor: David E. Ripple, Kirtland, Ohio

[73] Assignee: The Lubrizol Corporation, Wickliffe, Ohio

[21] Appl. No.: 995,605

[22] Filed: Dec. 21, 1992

[51] Int. Cl.[5] ..... C10M 137/10; C10M 141/10

[52] U.S. Cl. ..... 252/32.7 E; 252/32.7 R; 252/48.2

[58] Field of Search ..... 252/32.7 E, 32.7 R, 252/48.2

[56] References Cited

U.S. PATENT DOCUMENTS

| | | | |
|---|---|---|---|
| 2,207,719 | 7/1896 | Cohen et al. | 568/28 |
| 2,409,687 | 10/1946 | Rogers et al. | 252/400.51 |
| 3,285,854 | 11/1966 | Malone | 252/46.7 |
| 3,367,867 | 2/1968 | Abbott et al. | 252/33.4 |
| 3,390,082 | 6/1968 | Le Suer | 252/32.7 E |
| 3,442,808 | 5/1969 | Traise et al. | 252/49.6 |
| 3,522,179 | 7/1970 | Le Suer | 252/51.5 A |
| 3,634,515 | 1/1972 | Piasek et al. | 564/368 |
| 3,804,763 | 4/1974 | Meinhardt | 252/51.5 A |
| 3,929,654 | 12/1975 | Brewster et al. | 252/48.2 |
| 4,010,106 | 3/1977 | Rothert | 252/32.7 E |
| 4,191,659 | 3/1980 | Davis | 252/45 |
| 4,289,635 | 9/1981 | Schroeck | 252/32.7 E |
| 4,308,154 | 12/1981 | Clason et al. | 252/32.7 E |
| 4,326,972 | 4/1982 | Chamberlin, III | 252/33.3 |
| 4,867,890 | 9/1989 | Colclough et al. | 252/32.7 E |
| 4,867,890 | 9/1989 | Colclough et al. | 252/32.7 E |

FOREIGN PATENT DOCUMENTS

| | | | |
|---|---|---|---|
| 946032 | 8/1961 | United Kingdom . | |
| 1105729 | 5/1966 | United Kingdom | C07F 9/02 |

*Primary Examiner*—José G. Dees
*Assistant Examiner*—Dwayne C. Jones
*Attorney, Agent, or Firm*—Frederick D. Hunter; John H. Engelmann; Forrest L. Collins

[57] ABSTRACT

This invention provides an oil additive composition which may be used as an additive for both diesel engine lubricants and transmission lubricants. Additives useful in diesel engine lubricants often do not meet the requirements of specific transmission lubricant specifications. Surprisingly, the inventive composition, which comprises a combination of a neutral or basic alkali metal salt of a phenol sulfurized using elemental sulfur, a metal salt of a dithiophosphoric acid, an ashless dispersant, a calcium or magnesium sulfonate detergent, and a manganese carboxylate, may be used to create lubricants for both engine and transmission use.

79 Claims, No Drawings

OIL ADDITIVE PACKAGE USEFUL IN DIESEL ENGINE AND TRANSMISSION LUBRICANTS

FIELD OF THE INVENTION

This invention relates to an oil additive composition which may be used as an additive for diesel engine lubricants and as an additive in a transmission fluid. Diesel engine lubricants must pass a series of tests. Similarly, transmission lubricants are required to pass another series of tests. Surprisingly, the inventive composition may be used to create lubricants for both engine and transmission use.

BACKGROUND OF THE INVENTION

The inventive composition comprises a combination of a neutral or basic alkali metal salt of a phenol sulfurized using elemental sulfur, a metal salt of a dithiophosphoric acid, an ashless dispersant, a calcium or magnesium sulfonate detergent, and a manganese carboxylate.

The sulfurization of phenols is well known. U.S. Pat. No. 2,207,719 discloses a process in which a phenol or an alkylphenol is reacted with elemental sulfur to form molecules which are believed to be phenol disulfides or monosulfides.

U.S. Pat. No. 2,370,302 discloses the use of sulfurized phenates in lubricating compositions which are subjected to high temperatures. In particular, the invention is aimed at lubricating oils used in internal combustion engines.

U.S. Pat. No. 2,409,687 discloses the use of sulfur monochloride as a reagent for the sulfurization of alkylphenols.

U.S. Pat. No. 3,285,854 discloses the use of thiobisphenolic compounds to improve the stability of nonash-forming nitrogen-containing detergents in oil. Among the nitrogen-containing detergents disclosed are N-dialkylamino alkyl alkenyl succinimides illustrated by the compound N-dimethylamino propyl polybutenyl succinimide.

U.S. Pat. No. 3,367,867 discloses the use of overbased sulfurized calcium alkylphenates as detergents in lubricating oils. The method of sulfurization of the phenol is not critical to the invention.

U.S. Pat. No. 3,929,654 discloses the preparation of an additive for lubricating and fuel oils which is prepared by reacting an alkylphenol with sulfur in the presence of an organic amine.

U.S. Pat. No. 4,010,106 discloses functional fluid lubricating oil compositions which comprise an oil of lubricating viscosity and an effective amount of each of the following materials: 1) an alkenyl succinimide, 2) a Group II metal salt of a dihydrocarbyl dithiophosphoric acid, 3) a frictional modifier, 4) a basic sulfurized alkaline earth metal alkylphenate, and 5) a chlorinated olefin containing from about 15 to 50 carbon atoms, from 20 to 60% by weight chlorine, and having a boiling point of at least about 300.5° F. The chlorinated olefin may be present in the final functional fluid at levels ranging from 0.01 to 25% by weight, and more preferably from 0.05 to 0.5% by weight, and is particularly important in retarding corrosion of copper alloy parts within automatic transmissions.

U.S. Pat. No. 4,191,659 describes a method for the preparation of sulfurized compositions by reacting, under superatmospheric pressure, an olefinic compound with a mixture of sulfur and hydrogen sulfide in the presence of an acidic, basic or neutral catalyst, followed by removal of low boiling materials including unreacted olefin, mercaptan and monosulfide. An optional final step is removal of active sulfur; for example, by treatment with an alkali metal sulfide. The sulfurized compositions are stated to be useful as lubricant additives.

U.S. Pat. No. 4,874,007 discloses a process for preparing sulfurized alkyl-substituted phenols which are useful in preparing neutral and overbased phenate detergents.

British Patent 946,032 discloses a combination of sulfurated phenols and alkenyl-substituted succinimides. The succinimides are produced by reacting a polyalkenyl succinic anhydride with dialkylamino alkylamines.

U.S. Pat. No. 3,522,179 discloses lubricating compositions containing esters of hydrocarbon-substituted succinic acid. The hydrocarbon substituents generally have a molecular weight from 700 to 5000, although higher molecular weights may be employed. The alcohols from which the esters may be derived preferably contain up to 40 aliphatic carbon atoms.

U.S. Pat. No. 3,634,515 discloses the condensation product of a substituted alkyl phenol, an alkaline polyamine, formaldehyde and an aldehyde reactant having more than one carbon atom or a ketone reactant or mixture of both reactants.

U.S. Pat. No. 3,804,763 discloses dispersant compositions in which a carboxylic acylating agent is reacted with a hydroxy compound and also with a polyoxyalkylene polyamine.

U.S. Pat. No. 3,442,808 discloses that conventional Mannich condensation products may be further reacted with polyalkenyl succinic anhydrides to form a useful oil additive.

U.S. Pat. No. 4,867,890 titled "LUBRICATING OIL COMPOSITIONS CONTAINING ZINC DIHYDROCARBYLDITHIOPHOSPHATE, METAL DETERGENT, AND A COPPER COMPOUND" discloses a lubricating oil composition having improved properties which comprises a major proportion by weight of a lubricating oil, a dispersant compound, from 0.01 to 0.5 wt. % phosphorous and zinc and 5 to 500 parts per million of copper, and additive concentrates for blending with oil to produce such lubricating compositions.

Metal salts of phosphorodithioic acids are known lubricant additives. See, for example, U.S. Pat. Nos. 3,390,082 and 4,326,972. Metal salts of mixtures of phosphorodithioic acids and carboxylic acids are also known lubricant additives. See, for example, U.S. Pat. No. 4,308,154.

Preparations of phosphorodithioic acid usually involve the reaction of phosphorus pentasulfide ($P_2S_5$) and an alcohol or a phenol.

U.S. Pat. No. 4,289,635 discloses molybdenum-containing compositions prepared by reacting an olefinically unsaturated compound capable of reacting with active sulfur with a composition prepared by reacting (a) a phosphorus containing acid represented by the formula

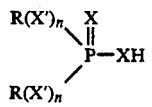

wherein each X and X' is independently oxygen or sulfur, each n is 0 or 1 and each R is independently the same or different hydrocarbon-based radical, and (b) at least one hexavalent molybdenum oxide compound, and (c) hydrogen sulfide, in the presence of (d) a polar solvent. These compositions are described as being useful as additives for lubricants.

British Patent No. 1,105,729 describes a process for preparing a metal salts of a phosphorus acid comprising the reaction of a Group II metal base with a phosphorus acid of the structural formula

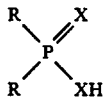

(wherein X is oxygen or sulfur, at least one X being sulfur, and each R is a substantially hydrocarbon or a substantially hydrocarbonoxy radical with the proviso that one R can be hydrogen) wherein the reaction is carried out in the presence of a catalyst selected from carboxylic acids having up to 10 aliphatic carbon atoms and salts thereof with a metal. The metal salts prepared in accordance with British Patent No. 1,105,729 are stated to be useful, among other applications, as additives in hydrocarbon compositions, lubricants, fuels and greases.

SUMMARY OF THE INVENTION

It is an object of the present invention to provide an additive package which is usable both in diesel engine oils and in transmission lubricants. Heretofore, additive packages have been developed for diesel engine lubricants which meet the API CD classification and the MACK T-6 and T-7 Tests. These diesel engine lubricants generally show poor results in the Caterpillar (T0-4) Transmission specification. Surprisingly, it has now been discovered that a composition which comprises:

I. a major amount of an oil of lubricating viscosity and

II. a minor amount of an additive comprising (A) neutral or basic calcium or magnesium salts of a sulfurized phenol formed by reacting a calcium or magnesium metal base with a sulfurized phenol which is formed by reacting elemental sulfur with a phenol of the following formula:

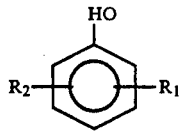

wherein $R_1$ and $R_2$ are independently selected from the group consisting of hydrogen, and alkyl groups containing from 1 to about 20 carbon atoms, provided that $R_1$ and $R_2$ may not both be hydrogen;

(B) one or more metal salts of a dithiophosphoric acid of the following formula:

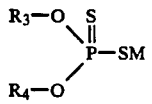

wherein $R_3$ and $R_4$ are independently selected from the group consisting of alkyl groups of 3 to about 18 carbon atoms and aryl groups, and alkyl substituted aryl groups (considered as aryl groups for the purpose of determining the ratio of aryl to alkyl groups) having one or more alkyl substituents containing a total of 1 to 18 carbon atoms, and the metal (N) is selected from the group consisting of Group I metals, Group II metals, tin, molybdenum, manganese, copper and zinc, provided that the level of phosphorous in the final oil composition is in the range of about 0.05 to 0.20 percent by weight in the composition, and further provided that the ratio between aryl groups and alkyl groups in the dithiophosphoric acid salt is between 0 and about 3; and (C) an ashless dispersant selected from the group consisting of (C-1) the reaction product of a hydrocarbyl substituted succinic acylating agent with an amine characterized by the presence within its structure of at least one H-N< group wherein said substituted succinic acylating agent consists of substituent groups and succinic groups wherein the substituent groups are derived from a polyalkene, said polyalkene being characterized by a Mn value of about 750 to about 5000 and an Mw/Mn value of about 1.5 to about 4, said acylating agents being further characterized by the presence within their structure of an average of at least 1.0 succinic groups for each equivalent weight of substituent groups, (C-2) a mannich dispersant, and a (C-3) an ester dispersant, (D) a calcium or magnesium neutral or overbased sulfonate detergent, and (E) a manganese carboxylate provided that the Total Base Number (TBN) contributed by the dispersant is between 0 and about 1.5 and the sulfated ash is 1.5 to 3%;

provides an additive which is useful in preparing a lubricant suitable for both diesel engine and transmission lubrication. Accordingly, the present invention provides for convenient operation of diesel fleets in that a single oil can be used for both the transmission and the engine.

DETAILED DESCRIPTION OF THE INVENTION

Surprisingly, applicants have now discovered that a single additive composition may be mixed with oils of lubricating viscosity to prepare oils for diesel engine lubricants and transmission lubricants as well as individual lubricants which may be utilized in both diesel engines and transmissions. This additive combination comprises a neutral or basic calcium or magnesium salt of a sulfurized phenol formed by reacting elemental sulfur with a phenol, one or more metal salts of a dithiophosphoric acid, an ashless dispersant, a neutral or overbased calcium or magnesium sulfonate detergent, and a manganese carboxylate.

The oil of lubricating viscosity which is utilized in the preparation of the lubricants of the invention may be based on natural oils, synthetic oils, or mixtures thereof.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propylene-isobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl)silicate, hexyl(4-methyl-2-pentoxy)-disiloxane, poly(methyl)siloxanes, poly(methylphenyl)-siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed herein- above can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

The (A) component of applicant's invention, that is, the neutral or basic calcium or magnesium salt (a phenate salt) of a sulfurized phenol is formed by reacting a phenol of the following formula:

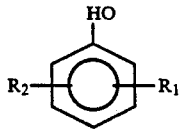

with elemental sulfur and further reacting with a calcium or magnesium base. $R_1$ and $R_2$ may independently be hydrogen or alkyl groups containing from 1 to about 20 carbon atoms, provided that $R_1$ and $R_2$ may not both be hydrogen. The alkyl groups may be straight chain, branched chain, or include cyclic structures.

In preparing the (A) component of the present invention, it is important that the sulfurized phenol derivative be prepared with elemental sulfur, rather than with a sulfur halide. This is illustrated by Example I which clearly shows the importance of using a sulfurized phenol coupled with elemental sulfur. Similar compositions which differ in that the phenate is coupled with a sulfur chloride in one case and elemental sulfur in the other produce different results. Only the composition with the phenate coupled with elemental sulfur passes the transmission wear test. The methods of sulfurizing a phenol using elemental sulfur are well known in the prior art. The molar ratio of sulfur to the phenol may vary from about 1:2 to about 3:4. The sulfurization of the phenol with elemental sulfur, is generally conducted in the presence of a base. A calcium or magnesium metal base such as magnesium oxide, calcium oxide, or calcium carbonate is often used. The quantity of base required ranges from about 0.1 to about 1.5 mole of base per mole of phenol.

A basic calcium or magnesium salt is a salt in which there is an excess of the metal base required to neutralize the phenol. Such salts are often referred to as overbased salts. An important characterisic of such salts is that they contain excess metal base in oil-soluble form. If the salt contains, for example, two equivalents of metal per equivalent of phenol, the metal ratio of that salt is said to be 2, and the salt may also be referred to as having a 200 conversion. Often, promoters and carbon dioxide are used in the neutralization process to increase the amount of metal incorporated into the salt. The methods of manufacture of overbased phenates are well known in the art and are not the subject of this invention. The salts usable in the composition of the present invention range from neutral salts, that is, conversion of 100, to overbased salts with a conversion of about 400.

The (B) component of the composition of the present invention consists of metal salts of phosphorus-containing acids, specifically, metals salts of at least one acid of the formula:

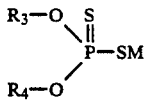

wherein $R_3$ and $R_4$ are independently selected from the group consisting of alkyl groups of 3 to about 18 carbon atoms and aryl groups, and alkyl substituted aryl groups (considered as aryl groups for the purpose of determining the ratio of aryl to alkyl groups) having one or more alkyl substituents containing a total of 1 to 18 carbon atoms, and the metal (M) is selected from the group consisting of Group I metals, Group II metals, tin, molybdenum, manganese, copper and zinc. Mixtures of these acids may be employed in accordance with this invention.

Primary, secondary, and tertiary alkyl and aryl groups may be present in the phosphorous containing acids. The preferred alkyl groups are C-3 to C-18, and particularly isopropyl, isobutyl, n-butyl, amyl, methylamyl, 2-ethylhexyl, octyl, isooctyl, decyl, dodecyl, tetradecyl, hexadecyl and octadecyl. While alkyl and aryl groups may be mixed in the same molecule, generally, if it is desired to balance the properties of aryl and alkyl zinc dithiophospates, this is achieved by mixing a purely alkyl zinc dithiophosphate with a purely aryl zinc dithiophosphate. Whether mixed within the same molecule, or arrived at as a combination of alkly and aryl molecules, molar ratio of aryl:alkyl groups should vary from 0:1 to about 2:1.

The additive of the present invention is intended to be used in preparing lubricant compositions. For the purposes of the present invention, it is important that the concentration of the phosphorous acids in the final oil composition fall in the range of 0.05 to about 0.20 percent by weight of the final oil composition. Accordingly, the additives of the present invention are formulated in such a manner that after dilution into the final oil composition, the concentration of the phosphorous acids in the oil composition is in the range of 0.05 to about 0.20 percent by weight.

The phosphorous containing acids are readily obtainable by the reaction of phosphorus pentasulfide ($P_2S_5$) and an alcohol or a phenol. Hydrogen sulfide is liberated in this reaction.

The metal of the phosphorous acid salt is selected from the group consisting of Group I metals, Group II metals, tin, molybdenum, manganese, copper and zinc. Zinc is the preferred metal.

The (C) component of the composition is an ashless dispersant. This includes the ester or nitrogen-containing derivatives of hydrocarbyl substituted carboxylic acylating agents, and Mannich dispersants. Ester or nitrogen-containing derivatives of hydrocarbyl substituted carboxylic acylating agents are prepared by reacting a hydrocarbyl substituted acylating agent with a suitable amine or ester forming molecule. The hydrocarbyl substituted acylating agents may be prepared by reacting a polyolefin with an acylating agent. Such acylating agents usually contain at least about 50 aliphatic carbon atoms. The preparation of acylating agents by reacting an olefin (e.g., a polyalkene such as polybutene) or a derivative thereof, is known. Typical unsaturated carboxylic acid derivatives include acrylic acid, methylacrylate, maleic acid, fumaric acid, and maleic anhydride. Exemplary of the patent literature are the following U.S., British and Canadian patents; U.S. Pat. Nos. 3,024,237; 3,087,936; 3,172,892; 3,215,707; 3,219,666; 3,231,587; 3,245,910; 3,272,746; 3,288,714; 3,312,619; 3,341,542; 3,367,943; 3,381,022; 3,454,607; 3,470,098; 3,630,902; 3,652,616; 3,755,169; 3,868,330; 3,912,764; 4,423,435; U.K. Pat. Nos. 944,136; 1,085,903; 1,162,436; 1,440,219; and Canadian Pat. No. 956,397.

A preferred dispersant in the present composition is a hydrocarbyl substituted succinic acylating agents which is reacted with an amine. These succinic acylating agents consist of substituent groups and succinic groups, wherein the substituent groups are derived from polyalkene, said polyalkene being characterized by a Mn value of 750 to about 3000 and a Mw/Mn value of about 1.5 to about 4, said acylating agent being characterized by the presence within its structure of an average of at least 1.0 succinic groups for each equivalent weight of substituent group. They may be prepared by reacting polyalkene characterized by a Mn value of 750 to about 5000 and a Mw/Mn value of about 1.5 to about 4, with one or more acidic reactants.

The acid reactants which are reacted with the polyalkene are characterized by the structure

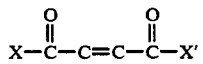

Formula I wherein X and X' are the same or different provided at least one of X and X' is such that the substituted succinic acylating agent can function as carboxylic acylating agents. That is, at least one of X and X' must be such that the substituted acylating agent can esterify alcohols, form amides or amine salts with ammonia or amines, form metal salts with reactive metals or basically reacting metal compounds, and otherwise function as a conventional carboxylic acid acylating agent. Transesterification and transamidation reactions are considered, for purposes of this invention, as conventional acylating reactions.

Thus, X and/or X' is usually —OH, —0—hydrocarbyl, —O⁻M⁺ where M⁺ represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylating reactions. Preferably, however, X and X' are each such that both carboxyl functions of the succinic group (i.e., both

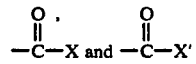

can enter into acylation reactions.

One of the unsatisfied valences in the grouping

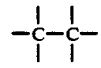

of Formula I forms a carbon-to-carbon bond with a carbon atom in the substituent group. While other such unsatisfied valence may be satisfied by a similar bond with the same or different substituent group, all but the said one such valence is usually satisfied by hydrogen atoms; i.e, —H. Derivatives of maleic or fumaric acid will generally be used. Ordinarily the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents of the present invention. The especially preferred reactants are maleic acid, maleic anhydride, and mixtures of these. Due to availability and ease of reaction, maleic anhydride will usually be employed.

The polyalkenes from which the substituent groups are derived are homopolymers and interpolymers of polymerizable olefin monomers of 2 to about 16 carbon atoms; usually 2 to about 6 carbon atoms. The interpolymers are those in which two or more olefin monomers are interpolymerized according to well-known conventional procedures to form polyalkenes having units within their structure derived from each of said two or more olefin monomers. Thus, "interpolymer(s)" as used herein is inclusive of copolymers, terpolymers, tetrapolymers, and the like. As will be apparent to those of ordinary skill in the art, the polyalkenes from which the substituent groups are derived are often conventionally referred to as "polyolefin(s)".

The olefin monomers from which the polyalkenes are derived are polymerizable olefin monomers characterized by the presence of one or more ethylenically unsaturated groups (i.e., >C=C<); that is, they are monoolefinic monomers such as ethylene, propylene, butene-1, isobutene, and octene-1 or polyolefinic monomers (usually diolefinic monomers) such as butadiene-1,3 and isoprene.

These olefin monomers are usually polymerizable terminal olefins; that is, olefins characterized by the presence in their structure of the group $>C{=}CH_2$. However, polymerizable internal olefin monomers (sometimes referred to in the patent literature as medial olefins) characterized by the presence within their structure of the group

C—C=C—C can also be used to form the polyalkenes. When internal olefin monomers are employed, they normally will be employed with terminal olefins to produce polyalkenes which are interpolymers. For purposes of this invention, when a particular polymerized olefin monomer can be classified as both a terminal olefin and an internal olefin, it will be deemed to be a terminal olefin. Thus, pentadiene-1,3 (i.e., piperylene) is deemed to be a terminal olefin for purposes of this invention.

Specific examples of terminal and internal olefin monomers which can be used to prepare the polyalkenes according to conventional, well-known polymerization techniques include ethylene; propylene; butene-1; butene-2; isobutene; pentene-1; hexene-1; heptene-1, octene-1, nonene-1; decene-1; pentene-2; propylene-tetramer; diisobutylene; isobutylene trimer; butadiene-1,2; butadiene-1,3; pentadiene-1,2; pentadiene-1,3; pentadiene-1,4; isoprene; hexadiene-1,5; 2-chloro-butadiene-1,3; 2-methyl-heptene-1; 3-cyclohexylbutene-1; 2-methyl-5-propyl-hexene-1; pentene-3; octene-4; 3,3-dimethyl-pentene-1; styrene; 2,4-dichloro styrene; divinylbenzene; vinyl acetate; allyl alcohol; 1-methyl-vinyl acetate; acrylonitrile; ethyl acrylate; methyl methacrylate; ethyl vinyl ether; and methyl vinyl ketone. Of these, the hydrocarbon polymerizable monomers are preferred and of these hydrocarbon monomers, the terminal olefin monomers are particularly preferred.

Specific examples of polyalkenes include polypropylenes, polybutenes, ethylene-propylene copolymers, styrene-isobutene copolymers, isobutene-butadiene-1,3 copolymers, propene-isoprene copolymers, isobutene-chloroprene copolymers, isobutene-(para-methyl)styrene copolymers, copolymers of hexene-1 with hexadiene-1,3, copolymers of octene-1 with hexene-1, copolymers of heptene-1 with pentene-1, copolymers of 3-methyl-butene-1 with octene-1, copolymers of 3,3-dimethyl-pentene-1 with hexene-1, and terpolymers of isobutene, styrene and piperylene. More specific examples of such interpolymers include copolymer of 95% (by weight) of isobutene with 5 % (by weight) of styrene; terpolymer of 98% of isobutene with 1% of piperylene and 1% of chloroprene; terpolymer of 95% of isobutene with 2% of butene-1 and 3% of hexene-1; terpolymer of 60% of isobutene with 20% of pentene-1 and 20% of octene-1; copolymer of 80% of hexene-1 and 20% of heptene-1; terpolymer of 90% of isobutene with 2% of cyclohexene and 8% of propylene; and copolymer of 80% of ethylene and 20% of propylene. A preferred source of polyalkenes are the poly(isobutene)s obtained by polymerization of $C_4$ refinery stream having a butene content of about 35 to about 75 percent by weight and an isobutene content of about 30 to about 60 percent by weight in the presence of a Lewis acid catalyst such as aluminum trichloride or boron trifluoride. These polybutenes contain predominantly (greater than about 80% of the total repeating units) of isobutene repeating units of the configuration

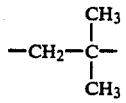

Obviously, preparing polyalkenes as described above which meet the various criteria for Mn and Mw/Mn is within the skill of the art and does not comprise part of the present invention. The methods of preparing these are well known to those skilled in the art and are not part of this invention. Several suitable methods are discussed in U.S. Pat. No. 4,234,435.

The amines used in preparing the (C-1) component of the present invention, which are characterized by the presence within their structure of at least one H—N< group, can be either monoamine or polyamine compounds. For purposes of this invention, hydrazine and substituted hydrazines containing up to three substituents are included as amines suitable for preparing carboxylic derivative compositions. Mixtures of two or more amines can be used in the reaction with one or more acylating reagents of this invention. Preferably, the amine contains at least one primary amino group (i.e., $-NH_2$) and more preferably the amine is a polyamine, especially a polyamine containing at least two H—N< groups, either or both of which are primary or secondary amines.

The monoamines and polyamines useful in the present invention must be characterized by the presence within their structure of at least one H—N< group. Therefore, they have at least one primary (i.e., $H_2N$—) or secondary amino (i.e., HN<) group. The amines can be aliphatic, cycloaliphatic, aromatic, or heterocyclic, including aliphatic-substitutedcycloaliphatic, aliphatic-substituted aromatic, aliphatic-substituted heterocyclic, cycloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted alicyclic, and heterocyclic-substituted aromatic amines and may be saturated or unsaturated. If unsaturated, the amine will be free from acetylenic unsaturation (i.e., —C≡C—). The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O— and —S— (e.g., as in such groups as —$CH_2CH_2$—X—$CH_2CH_2$— where X is —O— or —S—.

With the exception of the branched polyalkylene polyamine, the polyoxyalkylene polyamines, and the high molecular weight hydrocarbyl-substituted amines described more fully hereafter, the amines used as (a) ordinarily contain less than about 40 carbon atoms in total and usually not more than about 20 carbon atoms in total.

Aliphatic monoamines include mono-aliphatic and di-aliphatic substituted amines wherein the aliphatic groups can be saturated or unsaturated and straight or branched chain. Thus, they are primary or secondary aliphatic amines. Such amines include, for example, mono- and di-alkyl-substituted amines, mono- and di-alkenyl-substituted amines, and amines having one N-alkenyl substituent and one N-alkyl substituent and the like. The total number of carbon atoms in these aliphatic monoamines will, as mentioned before, normally not exceed about 40 and usually not exceed about 20 carbon atoms. Specific examples of such monoamines include ethylamine, diethylamine, n-butylamine, di-n-butylamine, allylamine, isobutylamine, cocoamine, sterylamine, laurylamine, methyllaurylamine, oleylamine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenethylamine, and 3-(furylpropyl)amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamines, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines, and pyranyl-substituted cyclohexylamines.

Aromatic amines suitable for preparation of the (C-1) dispersants include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di(para-methylphenyl)amine, naphthylamine, N-(n-butyl)aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

Polyamines suitable in preparing the (C-1) dispersant of the present invention include aliphatic, cycloaliphatic and aromatic polyamines analogous to the above-described monoamines except for the presence within their structure of another amino nitrogen. The other amino nitrogen can be a primary, secondary or tertiary amino nitrogen. Examples of such polyamines include N-amino-propyl-cyclohexylamines, N,N'-di-n-butyl-para-phenylene diamine, bis-(paraaminophenyl)methane, 1,4-diaminocyclohexane, and the like.

Heterocyclic mono- and polyamines may also be used in in making the (C-1) carboxylic derivative compositions of this invention. As used herein, the terminology "heterocyclic mono- and polyamine(s)" is intended to describe those heterocyclic amines containing at least one primary or secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain hetero atoms other than nitrogen, especially oxygen and sulfur. Obviously they can contain more than one nitrogen hetero atom. The five- and six-membered heterocyclic rings are preferred.

Among the suitable heterocyclics are aziridines, azetidines, azolidines, tetra- and di-hydro pyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-di-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-di-aminoethylpiperazine.

Hydroxyamines both mono- and polyamines, analogous to those described above are also useful in preparing (C-1) provided they contain at least one primary or secondary amino group. Hydroxy-substituted amines having only tertiary amino nitrogen such as in trihydroxyethyl amine, may not be used to prepare (C-1), but may be used to prepare the (C-3) ester dispersants The hydroxy-substituted amines contemplates are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, 3-hydroxybutyl-amine, 4-hydroxybutylamine, diethanolamine, di-(2-hydroxypropyl)-amine, N-(hydroxypropyl)-propylamine, N-(2-hydroxyethyl)cyclohexylamine, 3-hydroxycyclopentylamine, parahydroxyaniline, N-hydroxyethyl piperazine, and the like.

Also suitable as amines are the aminosulfonic acids and derivatives thereof corresponding to the general formula:

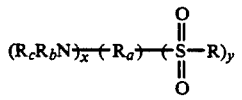

wherein R is —OH, —$NH_2$, $ONH_4$, etc., $R_a$ is a polyvalent organic radical having a valence equal to x+y; $R_b$ and $R_c$ are each independently hydrogen, hydrocarbyl, and substituted hydrocarbyl with the proviso that at least one of $R_b$ or $R_c$ is hydrogen per aminosulfonic acid molecule; x and y are each integers equal to or greater than one. From the formula, it is apparent that each amino sulfonic reactant is characterized by at least one NH< or $H_2N$— group and at least one

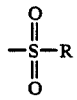

group. These sulfonic acids can be aliphatic, cycloaliphatic, or aromatic aminosulfonic acids and the corresponding functional derivatives of the sulfo group. Specifically, the aminosulfonic acids can be aromatic aminosulfonic acids, that is, where $R_2$ is a polyvalent aromatic radical such as phenylene where at least one

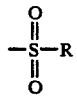

group is attached directly to a nuclear carbon atom of the aromatic radical. The aminosulfonic acid may also be a mono-amino aliphatic sulfonic acid; that is, an acid where x is one and $R_a$ is a polyvalent aliphatic radical such as ethylene, propylene, trimethylene, and 2-methylene propylene. These aminosulfonic acids may be reacted with the acylating reagents of this invention in the same way as other amino compounds. Other suitable aminosulfonic acids and derivatives thereof useful in preparing (C-1) are disclosed in U.S. Pat. Nos. 3,926,820; 3,029,250; and 3,367,843.

Hydrazine and substituted-hydrazine can also be used in preparing (C-I). At least one of the nitrogens in the hydrazine must contain a hydrogen directly bonded thereto. Preferably there are at least two hydrogens bonded directly to hydrazine nitrogen and, more preferably, both hydrogens are on the same nitrogen. The substituents which may be present on the hydrazine include alkyl, alkenyl, aryl, aralkyl, alkaryl, and the like. Usually, the substituents are alkyl, especially lower alkyl, phenyl, and substituted phenyl such as lower alkoxy substituted phenyl or lower alkyl substituted phenyl. Specific examples of substituted hydrazines are methylhydrazine, N,N-dimethyl-hydrazine, N,N-dimethylhydrazine, phenylhydrazine, N-phenyl-N'-dimethylhydrazine, phenylhydrazine, N-phenyl-N'-ethylhydrazine, N-(para-tolyl)-N'-(n-butyl)-hydrazine, N-(para-nitrophenyl)-hydrazine, N-(para-nitrophenyl)-N-methyl-hydrazine, N,N'-di(para-chlorophenol)-hydrazine, N-phenyl-N'-cyclohexylhydrazine, and the like.

The high molecular weight hydrocarbyl amines, both mono-amines and polyamines, which can be used in preparing (C-1) are generally prepared by reacting a chlorinated polyolefin having a molecular weight of at least about 400 with ammonia or amine. Such amines are known in the art and described, for example, in U.S. Pat. Nos. 3,275,554 and 3,438,757, both of which are expressly incorporated herein by reference for their disclosure in regard to how to prepare these amines. All that is required for use of these amines is that they possess at least one primary or secondary amino group.

Another group of amines suitable for use in preparing (C-1) are branched polyalkylene polyamines. The branches polyalkylene polyamines are polyalkylene polyamines wherein the branched group is a side chain containing on the average of at least one nitrogen-bonded aminoalkylene

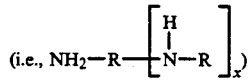

group per nine amino units present on the main chain, for examples, 1–4 of such branched chains per nine units on the main chain, but preferably one side chain unit per nine main chain units. Thus, these polyamines contain at least three primary amino groups and at least one tertiary amino group.

There reagents may be expressed by the formula:

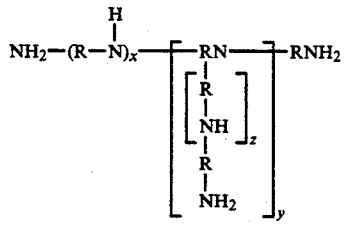

wherein R is an alkylene group such as ethylene, propylene, butylene and other homologues (both straight chained and branched), etc., but preferably ethylene; and x, y and z are integers, x being for example, from 4 to 24 or more but preferably 6 to 18, y being for example 1 to 6 or more but preferably 1 to 3, and z being for example 0–6 but preferably 0–1. The x and y units may be sequential, alternative, orderly or randomly distributed.

The preferred class of such polyamines includes those of the formula.

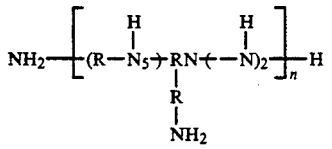

wherein n is an integer, for example, 1–20 or more but preferably 1–3, wherein R is preferably ethylene, but may be propylene, butylene, etc. (straight chained or branched).

The preferred embodiments are presented by the following formula:

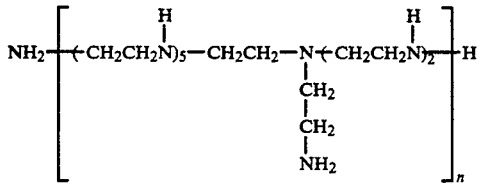

(n = 1–3).

The radicals in the brackets may be joined in a head-to-head or a head-to-tail fashion. Compounds described by this formula wherein n=1–3 are manufactured and sold as Polyamines N-400, N-800, N-1200, etc. Polyamine N-400 has the above formula wherein n=1.

U.S. Pat. Nos. 3,200,106 and 3,259,578 disclose methods of preparing such polyamines and processes for reacting them with carboxylic acid acylating agents since analogous processes can be used with the acylating reagents of this invention.

Suitable amines also include polyoxyalkylene polyamines, e.g., polyoxyalkylene diamines and polyoxyalkylene triamines, having average molecular weights ranging from about 200 to 4000 and preferably from about 400 to 2000. Illustrative examples of these polyoxyalkylene polyamines may be characterized by the formulae:

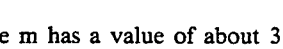

where m has a value of about 3 to 70 and preferably about 10 to 35.

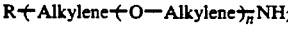

where n is such that the total value is from about 1 to 40 with the proviso that the sum of all of the n's is from about 3 to about 70 and generally from about 6 to about 35 and R is a polyvalent saturated hydrocarbon radical of up to ten carbon atoms having a valence of 3 to 6. The alkylene groups may be straight or branched chains and contain from 1 to 7 carbon atoms, and usually from 1 to 4 carbon atoms. The various alkylene groups present within formulae may be the same or different. More specific examples of these polyamines include:

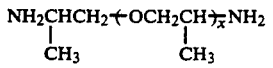

wherein x has a value of from about 3 to 70 and preferably from about 10 to 35 and

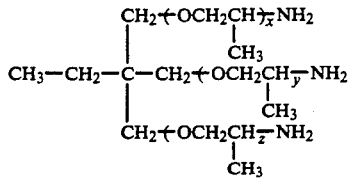

wherein x+y+z have a total value ranging from about 3 to 30 and preferably from about 5 to 10.

The preferred polyoxyalkylene polyamines for purposes of this invention include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403, etc.".

U.S. Pat Nos. 3,804,763 and 3,948,800 disclose such polyoxyalkylene polyamines and process for acylating them with carboxylic acid acylating agents which processes can be applied to their reaction with the acylating reagents of this invention.

Another preferred group of amines for use in preparing (C-1) are the alkylene polyamines, including the polyalkylene polyamines, as described in more detail hereafter. The alkylene polyamines include those confirming to the formula

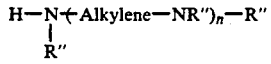

wherein n is from 1 to about 10; each R' is independently a hydrogen atom, a hydrocarbyl group or a hydroxy-substituted hydrocarbyl group having up to about 30 atoms, and the "Alkylene" group has from about 1 to about 10 carbon atoms but the preferred alkylene is ethylene or propylene. Especially preferred are the alkylene polyamines where each R" is hydrogen with the ethylene polyamines and mixtures of ethylene polyamines being the most preferred. Usually n will have an average value of from about 2 to about 7. Such alkylene polyamines include methylene polyamine, ethylene polyamines, butylene polyamines, propylene polyamines, pentylene polyamines, hexylene polyamines, heptylene polyamines, etc. The higher homologs of such amines and related aminoalkyl-substituted piperazines are also included.

Alkylene polyamines useful in preparing the carboxylic derivative compositions include ethylene diamine, triethylene tetramine, propylene diamine, trimethylene diamine, hexamethylene diamine, decamethylene diamine, octamethylene diamine, di(heptamethylene)triamine, tripropylene tetramine, tetraethylene pentamine, trimethylene diamine, pentaethylene hexamine, di(trimethylene)triamine, N-(2-aminoethyl)piperazine, 1,4-bis(2-aminoethyl)piperazine, and the like. Higher homologs as are obtained by condensing two or more of the above-illustrated alkylene amines are useful as are mixtures of two or more of any of the aforedescribed polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, which is hereby incorporated by reference for their disclosure of useful polyamines. Such compounds are prepared most conveniently by the reaction of an alkylene chloride with ammonia or by reaction of an ethylene imine with a ring-opening reagne tsuch as ammonia, etc. These reactions result in the production of the somewhat complex mixtures of alkylene polyamines, including cyclic condensation products such as piperazines. The mixtures are particularly useful in preparing novel sulfur-containing compositions of matter of this invention. On the other hand, quite satisfactory products can also be obtained by the use of pure alkylene polyamines.

Hydroxyalkyl alkylene polyamines having one or more hydroxyalkyl substituents on the nitrogen atoms, are also useful in preparing amide or ester functional derivatives of the aforedescribed olefinic carboxylic acids. Preferred hydroxyalkyl-substituted alkylene polyamines are those in which the hydroxyalkyl group is a lower hydroxyalkyl group, i.e., having less than eight carbon atoms. Examples of such hydroxyalkyl-substituted polyamines include N-(2-hydroxyethyl-)ethylene diamine, N,N-bis(2-hydroxyethyl)ethylene diamine, 1-(2-hydroxyethyl)piperazine, monohydroxypropyl-substituted diethylene triamine, dihydroxypropyl-substituted tetraethylene pentamine, N-(3-hydroxybutyl)tetramethylene diamine, etc. Higher homologs as are obtained by condensation of the above-illustrated hydroxy alkylene polyamines through amino radicals or through hydroxy radicals are likewise useful in preparing (C-1). Condensation through amino radicals results in a higher amine accompanied by removal of ammonia and condensation through the hydroxy radicals results in products containing ether linkages accompanied by removal of water.

The carboxylic derivative compositions produced from the acylating reagents of this invention and the amines described hereinbefore- produce acylated amines which include amine salts, amides, imides and imidazolines as well as mixtures thereof. To prepare carboxylic acid derivatives from the acylating reagents and the amines, one or more acylating reagents and one or more amines are heated, optionally in the presence of a normally liquid, substantially inert organic liquid solvent/diluent, at temperatures in the range of about 80° C. up to the decomposition point (where the decomposition point is as previously defined) but normally at temperatures in the range of about 100° C. up to about 300° C. provided 300° C. does not exceed the decomposition point. Temperatures of about 125° C. to about 250° C. are normally used. The acylating reagent and the amine are reacted in amounts sufficient to provide from about one-half equivalent to about 2 moles of amine per equivalent of acylating reagent. For purposes of this invention an equivalent of amine is that amount of the amine corresponding to the total weight of amine divided by the total number of nitrogens present. Thus, octylamine has an equivalent weight equal to its molecular weight; ethylene diamine has an equivalent weight equal to one-half its molecular weights; and aminoethylpiperazine has an equivalent weight equal to one-third its molecular weight.

Another type of ashless dispersant which is useful in the present invention is the so-called Mannich dispersant (the (C-2) component). Mannich dispersants are generally prepared by condensing one mole of an alkyl-substituted phenol with about 1 to 2.5 moles of formaldehyde and about 0.5 to 2 moles of an amine. The primary and secondary amines described above as suitable for use in preparing the nitrogen containing alkenylsuccinic derivatives are suitable for the preparation of the Mannich dispersants. The Mannich condensation products may be further reacted with an alkenylsuccinic anhydride to form the final Mannich additive. The alkenyl substituent on the succinic anhydride may have a Mn value from approximately 750 to about 5000. The alkyl substituent on the phenol may be from C6 to $C_{12}$. Polyalkylene polyamines are convenient materials for use in the preparation of Mannich dispersants. Such amines are derived from the condensation of ethylene diamine or propylene diamine and includes products such as diethylene triamine, triethylene tetramine, tetraethylene pentamine, or pentaethylene hexamine, dipropylene triamine, tripropylene tetramine, tetrapropylene pentamine or pentapropylene hexamine. In addition, polyethyleneamine stillbottoms may be used. The dispersants may be prepared by the methods set forth in U.S. Pat. No. 3,424,808, or similar methods well known to those skilled in the art.

Another variety of ashless dispersants which may be used in the composition of the present invention are the ester dispersants (the (C-3) component). Ester dispersants are prepared by reacting an alkenylsuccinic anhydride with a polyalcohol. The substituted succinic anhydrides used in the preparation of the (C-i) materials may be used to prepare the the ester dispersants useful in the present invention. The nature of these dispersants and their preparation are described in U.S. Pat. Nos. 3,522,179 and 4,234,435. The hydrocarbon substituent of the hydrocarbon-substituted succinic acids generally appear hydrocarbon in character, although they may contain a small quantity of non-hydrocarbon groups. Most frequently, the hydrocarbon substituents are olefin polymers. The substituted succinic acid compound are then reacted with hydroxy compounds to form esters. The hydroxy compounds may be aliphatic monohydric or polyhydric alcohols or may include aromatic compounds such as phenols and naphthols. Such esters are described in U.S. Pat. Nos. 3,522,179 and 4,234,435. The esters produced by the reaction between they hydroxy compound and the substituted succinic acid may be further reacted with amines. Such materials, and methods for producing them, are disclosed in U.S. Pat. No. 3,804,763. Hydroxy amines may be included as the hydroxy reactant, and polyoxyalkalene polyamines and alkalene polyamines may be used as amine reactants with the subject esters. The amines, substituted amines, and hydroxy amines disclosed as useful in the preparation of the (C-1) component are useful in this preparation as well.

In formulating compositions according to the present invention, it is important that the Total Base Number (TBN) contributed by the ashless dispersant be no more than 1.5. Total base number is measured by ASTM method D-974 and is expressed as milligrams of KOH equivalent per gram of lubricant. Maintaining this TBN contribution at 1.5 or below is particularly important in assuring that the composition will be suitable for use in transmissions.

The (D) component of applicants' invention is a calcium or magnesium neutral or overbased sulfonate detergent. Sulfonic acids include those represented by the formulae $R^1(SO_3H)_r$ and $(R_2)_xT(SO_3H)_y$. In these formulae, $R^1$ is an aliphatic or aliphatic-substituted cycloaliphatic hydrocarbon or essentially hydrocarbon radical free from acetylenic unsaturation and containing up to about 60 carbon atoms. When $R_1$ is aliphatic, it usually contains at least about 18 carbon atoms; when it is an aliphatic-substituted cycloaliphatic radical, the aliphatic substituents usually contain a total of at least about 12 carbon atoms. Examples of $R^1$ are alkyl, alkenyl and alkoxyalkyl radicals, and aliphatic-substituted cycloaliphatic radicals wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of $R_1$ are cetylcyclohexyl, laurylcyclohexyl, cetyloxyethyl, octadecenyl, and radicals derived from petroleum, saturated and unsaturated paraffin wax, and olefin polymers including polymerized monoolefins and diolefins containing about 2-8 carbon atoms per olefinic monomer unit. $R^1$ can also contain other substituents such as phenyl, cycloalkyl, hydroxy, lower alkoxy, lower alkylmercapto, carboxy, carbalkoxy, oxo or thio, or interrupting groups such as —NH—, —O— or —S—, as long as the essentially hydrocarbon character thereof is not destroyed.

$R^2$ is generally a hydrocarbon or essentially hydrocarbon radical free from acetylenic unsaturation and containing from about 4 to about 60 aliphatic carbon atoms, preferably an aliphatic hydrocarbon radical such as alkyl or alkenyl. It may also, however, contain substituents or interrupting groups such as those enumerated above provided the essentially hydrocarbon character thereof is retained. In general, any non-carbon atoms present in $R^1$ or $R^2$ do not account for more than 10% of the total weight thereof.

T is a cyclic nucleus which may be derived from an aromatic hydrocarbon such as benzene, naphthalene, anthracene or biphenyl, or from a heterocycllic compound such as pyridine, indole or isoindole. Ordinarily, T is an aromatic hydrocarbon nucleus, especially a benzene or naphthalene nucleus.

The subscript x is at least 1 and is generally 1-3. The subscripts r and y have an average value of about 1-4 per molecule and are generally also 1.

The following are specific examples of sulfonic acids useful in preparing the (D) component of the present invention. Such sulfonic acids include mahogany sulfonic acids, bright stock sulfonic acids, petroleum sulfonic acids (including all sulfonic acids which are derived from petroleum products), mono- and polywax-substituted naphthalene sulfonic acids, cetyl- chlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetraisobutylene sulfonic acids, tetra-amylene sulfonic acids, chloro-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonicacids, dodecylbenzene sulfonic acids, "dimer alkylate" sulfonic acids, phenol sulfonic, diphenyl ether sulfonic, diphenyl ether disulfonic, naphthalene, disulfide sulfonic, naphthalene disulfide disulfonic, thiophene sulfonic, alpha-chloronaphthalene sulfonic acids, and the like.

Alkyl-substituted benzene sulfonic acids wherein the alkyl group contains at least 8 carbon atoms including dodecyl benzene "bottoms" sulfonic acids are particularly useful. The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology" Second Edition, Vol 19, pp 291 et seq. published by John Wiley & Sons, N.Y. (1969).

Other descriptions of basic sulfonate salts and techniques for making them can be found in the following U.S. Pat. Nos.: 2,174,110; 2,202,781; 2,239,974; 2,319,121; 2,337,552; 3,488,284; 3,595,790; and 3,798,012.

Overbased salts are well known. The method for their preparation is commonly referred to as overbasing. The term "metal ratio" is often used to define the quantity of metal in these salts relative to the quantity of organic anion, and is defined as the ratio of the number of equivalents of metal present in the salt compared to amount of metal which would be present in a normal salt, based upon the usual stoichiometry of the compounds involved.

The (E) component of the present composition is an oil soluble manganese carboxylate. In order to assure oil solubility, the organic group of the carboxylic acid should contain at least about 7 carbon atoms. Both straight and branched chain mono-carboxylic acids may be used. Generally, mono-carboxylic acids containing from about 8 to 18 carbon atoms are suitable for use is preparing the manganese carboxylates useful in the present invention. Poly-carboxylic acids, particularly di- and tri-carboxylic acids, may also be used. Dimer and trimer acids as well as substituted succinic acids may be used. Generally, the manganese carboxylate is present at low levels in the final oil composition. The additive of the present invention is prepared so that the final oil composition will have manganese carboxylate levels such that the manganese level in the final oil composition will be from about 0.0004 to 0.04 weight percent.

It is important that the sulfated ash level contributed by all components be in the range of 1.5-3%. If the sulfated ash is less than this level, the composition would probably not pass the diesel engine tests. On the other hand, at levels of sulfated ash above 3% it is likely that transmision performance would suffer.

The lubricants of the present invention are useful in the prevention of undesirable oil viscosity increases which may occur during operation of diesel engines. In addition, the lubricants of the present invention are capable of passing other tests of diesel lubricant performance such as the Mack T-6 test and the Mack T-7 test.

The advantages of the diesel lubricants of the present invention is demonstrated by subjecting the diesel lubricants of lubricant Examples III-V to the Mack Truck Technical Services Standard Test Procedure No. 5GT57 entitled "Mack T-7: Diesel Engine Oil Viscosity Evaluation" dated Aug. 31, 1984 This test has been designed to correlate with field experience. In this test, a Mack EM6-285 engine is operated under low speed, high torque, steady-state conditions. The engine is a direct injection, in-line, six-cylinder, four-stroke, turbocharged series charge air-cooled compression ignition engine containing keystone rings. The rated power is 283 bhp at 2300 rpm governed speed.

The test operation consists of an initial break-in period (after major rebuild only) a test oil flush, and 150 hours of steady state operation at 1200 rpm and 1080 ft/lb. of torque. No oil changes or additions are made, although eight 4 oz. oil samples are taken periodically from the oil pan drain valve during the test for analysis. Sixteen ounces of oil are taken at the oil pan drain valve before each 4 oz. sample is taken to purge the drain line. This purge sample is then returned to the engine after sampling. No make-up oil is added to the engine to replace the 4 oz. samples.

The kinematic viscosity at 210° F. can be measured by two procedures. In both procedures, the sample is passed through a No. 200 sieve before it is loaded into the Cannon reverse flow viscometer. In the ASTM D-445 method, the viscometer is chosen to result in flow times equal to or greater than 200 seconds. In the method described in the Mack T-7 specification, a Cannon 300 viscometer is used for all viscosity determinations. Flow times for the latter procedure are typically 50–100 seconds for fully formulated 15W-40 diesel lubricants.

The lubricants of the present invention also pass the TO-4 specification. This specification is a multifaceted test of the performance of an oil as a gear lubricant in a transmission. It includes the well known FZG test which is primarily applicable to tractor hydraulic fluids, but is suitable for other applications, and has been widely adapted as used to screen lubricants for gear wear. The method has been adopted as an ASTM standard, and the procedure is fully described in ASTM method D4998. The maximum acceptable weight loss in this test is 100 milligrams as an average of three separate runs, with no single run having more than 150 milligram weight loss.

EXAMPLE 1

Two diesel oil additive packages were prepared. The packages were similar with the exception that the first package contained sulfurized phenates formed by coupling with sulfur chlorides, and the second package contained sulufurized phenates coupled with elemental sulfur. The composition of the two packages is shown in Table I.

TABLE I

| Lubricant Additive | Baseline Additive (Wt. %) IN THE FINISHED OILS | Inventive Additive (Wt. %) IN THE FINISHED OILS |
|---|---|---|
| Dispersant: | | |
| Succinic Ester | 3.01 | 2.95 |
| Succinimide | 3.01 | 2.95 |

TABLE I-continued

| Lubricant Additive | Baseline Additive (Wt. %) IN THE FINISHED OILS | Inventive Additive (Wt. %) IN THE FINISHED OILS |
|---|---|---|
| Detergent: | | |
| Calcium Sulfonate 1100 Conversion | 0.98 | 0.96 |
| Calcium Sulfonate 120 Conversion | 2.87 | 2.81 |
| Zinc Dithiophosphates: | | |
| Didodecylphenyl zinc dithiophosphate | 1.49 | 1.46 |
| Diisooctyl zinc dithiophosphate | 0.68 | 0.66 |
| Sulfur-coupled phenates: | | |
| Elemental sulfur-coupled (90 TBN) | — | 9.14 |
| Elemental sulfur-coupled (255 TBN) | — | 1.12 |
| Sulfur chloride-coupled (200 TBN) | 3.73 | — |
| Sulfur chloride-coupled (0 TBN) | 1.02 | — |
| Sulfur chloride-coupled (90 TBN) | 2.45 | — |
| Manganese Carboxylate | 0.017 0.0068% Mn | 0.018 0.0072% Mn |
| Foam Inhibitor | 0.011 | 0.012 |
| Diluent Oil | 0.14 | 0.13 |
| Total Base Number | 13.5 | 14.8 |

Each of these compositions was tested in the FZG test. Any value of less than 100 milligrams weight loss is considered a passing performance on the FZG test. The baseline additive produced a weight loss of 160 milligrams, while the inventive composition produced a weight loss of 25 milligrams.

I claim:

1. A lubricating composition which comprises

I. a major amount of an oil of lubricating viscosity and

II. a minor amount of an additive comprising (A) neutral or basic calcium or magnesium salts of a sulfurized phenol formed by reacting a calcium or magnesium metal base with a sulfurized phenol which is formed by reacting elemental sulfur with a phenol of the following formula:

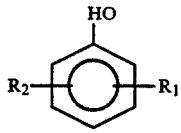

wherein $R_1$ and $R_2$ are independently selected from the group consisting of hydrogen, and alkyl groups containing from 1 to about 20 carbon atoms, provided that $R_1$ and $R_2$ may not both be hydrogen;

(B) one or more metal salts of a dithiophosphoric acid of the following formula:

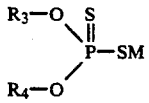

wherein $R_3$ and $R_4$ are independently selected from the group consisting of alkyl groups of 3 to about 18 carbon atoms, aryl groups, and alkyl substituted aryl groups (considered as aryl groups for the purpose of determining the ratio of aryl to alkyl groups) having one or more alkyl substituents containing a total of 1 to 18 carbon atoms, and the metal (M) is selected from the group consisting of Group I metals, Group II metals, tin, molybdenum, manganese, and zinc, provided that the level of phosphorous in the final oil composition is in the range of about 0.05 to about 0.20 percent by weight in the composition, and further provided that the ratio between aryl groups and alkyl groups in the dithiophosphoric acid salt is between 0 and about 3; and (C) an ashless dispersant selected from the group consisting of (C-1) the reaction product of a hydrocarbyl substituted succinic acylating agent with an amine characterized by the presence within its structure of at least one H—N< group wherein said substituted succinic acylating agent consists of substituent groups and succinic groups wherein the substituent groups are derived from a polyalkene, said polyalkene being characterized by a Mn value of about 750 to about 5000 and an Mw/Mn value of about 1.5 to about 4, said acylating agents being further characterized by the presence within their structure of an average of at least 1.0 succinic groups for each equivalent weight of substituent groups, (C-2) a mannich dispersant, (C-3) an ester dispersant, (C-4) a mixture of C-1, C-2, or C-3, (D) a calcium or magnesium neutral or overbased sulfonate detergent, or mixtures thereof, and (E) a manganese carboxylate provided that the TBN contributed by the dispersant is between 0 and about 1.5 and the sulfated ash is 1.5 to 3%.

2. A lubricating composition according to claim 1 wherein the dispersant is the reaction product of a hydrocarbyl substituted succinic acylating agent with an amine characterized by the presence within its structure of at least one H—N< wherein said substituted succinic acylating agent consists of substituent groups and succinic groups wherein the substituent groups are derived from a polyalkylene, said polyalkylene being characterized by an Mn value of about 750 to about 5000 and an Mw/Mn value of about 1.5 to about 4, said acylating agents being further characterized by the presence within their structure of an average of at least 0.8 succinic groups for each equivalent weight of substituent groups.

3. A lubricating composition according to claim 2 wherein $R_1$ is H and $R_2$ is H or an alkyl group containing from 1 to 9 carbon atoms.

4. A lubricating composition according to claim 3 wherein the metal of the dithiophosphoric acid salt is zinc.

5. A lubricating composition according to claim 3 wherein $R_3$ and $R_4$ are both alkyl groups.

6. A lubricating composition according to claim 3 wherein the (B) component is a mixture of salts formed from one or more acids in which $R_3$ and $R_4$ are alkyl groups, and one or more acids in which $R^3$ and $R_4$ are aryl groups and alkylaryl groups, provided that the molar ratio of aryl to alkyl groups is in the range of 1:2 to 3:2.

7. A lubricating composition according to claim 3 wherein the sulfonate detergent is a calcium alkylbenzene sulfonate.

8. A lubricating composition according to claim 2 wherein $R_1$ is H and $R_2$ is an alkyl group containing from 10 to 20 carbon atoms.

9. A lubricating composition according to claim 8 wherein the metal of the dithiophosphoric acid salt is zinc.

10. A lubricating composition according to claim 8 wherein $R_3$ and $R_4$ are both alkyl groups.

11. A lubricating composition according to claim 8 wherein the (B) component is a mixture of salts formed from one or more acids in which $R_3$ and $R_4$ are alkyl groups, and one or more acids in which $R_3$ and $R_4$ are aryl groups and alkylaryl groups, provided that the molar ratio of aryl to alkyl groups is in the range of 1:2 to 3:2.

12. A lubricating composition according to claim 8 wherein the sulfonate detergent is a calcium alkylbenzene sufonate.

13. A lubricating composition according to claim 2 wherein $R_1$ and $R_2$ are both alkyl groups containing from 1 to 9 carbon atoms.

14. A lubricating composition according to claim 13 wherein the metal of the dithiophosphoric acid salt is zinc.

15. A lubricating composition according to claim 13 wherein $R_3$ and $R_4$ are both alkyl groups.

16. A lubricating composition according to claim 13 wherein the (B) component is a mixture of salts formed from one or more acids in which $R_3$ and $R_4$ are alkyl groups, and one or more acids in which $R_3$ and $R_4$ are aryl groups and alkylaryl groups, provided that the molar ratio of aryl to alkyl groups is in the range of 1:2 to 3:2.

17. A lubricating composition according to claim 13 wherein the sulfonate detergent is a calcium alkylbenzene sulfonate.

18. A lubricating composition according to claim 2 wherein $R^1$ is an alkyl group containing from 1 to 9 carbon atoms, and $R_2$ is an alkyl group containing from 10 to 20 carbon atoms.

19. A lubricating composition according to claim 18 wherein the metal of the dithiophosphoric acid salt is zinc.

20. A lubricating composition according to claim 18 wherein $R_3$ and $R_4$ are both alkyl groups.

21. A lubricating composition according to claim 18 wherein the (B) component is a mixture of salts formed from one or more acids in which $R_3$ and $R_4$ are alkyl groups, and one or more acids in which $R_3$ and $R_4$ are aryl groups and alkylaryl groups, provided that the molar ratio of aryl to alkyl groups is in the range of 1:2 to 3:2.

22. A lubricating composition according to claim 18 wherein the sulfonate detergent is calcium alkylbenzene sulfonate.

23. A lubricating composition according to claim 2 wherein $R_1$ and $R_2$ are both alkyl groups containing from 10 to 20 carbon atoms.

24. A lubricating composition according to claim 23 wherein the metal of the dithiophosphoric acid salt is zinc.

25. A lubricating composition according to claim 23 wherein $R_3$ and $R_4$ are both alkyl groups.

26. A lubricating composition according to claim 23 wherein the (B) component is a mixture of salts formed from one or more acids in which $R^3$ and $R_4$ are alkyl groups, and one or more acids in which $R_3$ and $R_4$ are aryl groups and alkylaryl groups, provided that the molar ratio of aryl to alkyl groups is in the range of 1:2 to 3:2.

27. A lubricating composition according to claim 23 wherein the sulfonate detergent is calcium alkylbenzene sulfonate.

28. A lubricating composition according to claim 1 wherein the ashless dispersant is an ester dispersant.

29. A lubricating composition according to claim 28 wherein $R^1$ is H and $R_2$ is H or an alkyl group containing from 1 to 9 carbon atoms.

30. A lubricating composition according to claim 29 wherein the metal of the dithiophosphoric acid salt is zinc.

31. A lubricating composition according to claim 29 wherein $R_3$ and $R^4$ are both alkyl groups.

32. A lubricating composition according to claim 29 wherein the (B) component is a mixture of salts formed from one or more acids in which $R_3$ and $R^4$ are alkyl groups, and one or more acids in which $R_3$ and $R_4$ are aryl groups and alkylaryl groups, provided that the molar ratio of aryl to alkyl groups is in the range of 1:2 to 3:2.

33. A lubricating composition according to claim 29 wherein the sulfonate detergent is a calcium alkylbenzene sulfonate.

34. A lubricating composition according to claim 28 wherein $R^1$ is H and $R_2$ is an alkyl group containing from 10 to 20 carbon atoms.

35. A lubricating composition according to claim 34 wherein the metal of the dithiophosphoric acid salt is zinc.

36. A lubricating composition according to claim 34 wherein $R^3$ and $R_4$ are both alkyl groups.

37. A lubricating composition according to claim 34 wherein the (B) component is a mixture of salts formed from one or more acids in which $R^3$ and $R_4$ are alkyl groups, and one or more acids in which $R_3$ and $R^4$ are aryl groups and alkylaryl groups, provided that the molar ratio of aryl to alkyl groups is in the range of 1:2 to 3:2.

38. A lubricating composition according to claim 34 wherein the sulfonate detergent is calcium alkylbenzene sulfonate.

39. A lubricating composition according to claim 28 wherein $R_1$ and $R_2$ are both alkyl groups containing from 1 to 9 carbon atoms.

40. A lubricating composition according to claim 39 wherein the metal of the dithiophosphoric acid salt is zinc.

41. A lubricating composition according to claim 39 wherein $R_3$ and $R_4$ are both alkyl groups.

42. A lubricating composition according to claim 39 wherein the (B) component is a mixture of salts formed from one or more acids in which $R_3$ and $R_4$ are alkyl groups, and one or more acids in which $R_3$ and $R_4$ are aryl groups and alkylaryl groups, provided that the molar ratio of aryl to alkyl groups is in the range of 1:2 to 3:2.

43. A lubricating composition according to claim 39 wherein the sulfonate detergent is a calcium alkylbenzene sulfonate.

44. A lubricating composition according to claim 28 wherein R, is an alkyl group containing from 1 to 9 carbon atoms, and $R_2$ is an alkyl group containing from 10 to 20 carbon atoms.

45. A lubricating composition according to claim 44 wherein the metal of the dithiophosphoric acid salt is zinc.

46. A lubricating composition according to claim 44 wherein $R^3$ and $R_4$ are both alkyl groups.

47. A lubricating composition according to claim 44 wherein the (B) component is a mixture of salts formed from one or more acids in which $R^3$ and $R_4$ are alkyl groups, and one or more acids in which $R_3$ and $R_4$ are aryl groups and alkylaryl groups, provided that the molar ratio of aryl to alkyl groups is in the range of 1:2 to 3:2.

48. A lubricating composition according to claim 44 wherein the sulfonate detergent is calcium alkylbenzene sulfonate.

49. A lubricating composition according to claim 28 wherein $R^1$ and $R_2$ are both alkyl groups containing from 10 to 20 carbon atoms.

50. A lubricating composition according to claim 49 wherein the metal of the dithiophosphoric acid salt is zinc.

51. A lubricating composition according to claim 49 wherein $R_3$ and $R_4$ are both alkyl groups.

52. A lubricating composition according to claim 49 wherein the (B) component is a mixture of salts formed from one or more acids in which $R_3$ and $R_4$ are alkyl groups, and one or more acids in which $R_3$ and $R_4$ are aryl groups and alkylaryl groups, provided that the molar ratio of aryl to alkyl groups is in the range of 1:2 to 3:2.

53. A lubricating composition according to claim 49 wherein the sulfonate detergent is calcium alkylbenzene sulfonate.

54. A lubricating composition according to claim 1 wherein the ashless dispersant is a mannich dispersant.

55. A lubricating composition according to claim 54 wherein $R_1$ is H and $R_2$ is H or an alkyl group containing from 1 to 9 carbon atoms.

56. A lubricating composition according to claim 55 wherein the metal of the dithiophosphoric acid salt is zinc.

57. A lubricating composition according to claim 55 wherein $R_3$ and $R_4$ are both alkyl groups.

58. A lubricating composition according to claim 55 wherein the (B) component is a mixture of salts formed from one or more acids in which $R^3$ and $R^4$ are alkyl groups, and one or more acids in which $R^3$ and $R^4$ are aryl groups and alkylaryl groups, provided that the molar ratio of aryl to alkyl groups is in the range of 1:2 to 3:2.

59. A lubricating composition according to claim 55 wherein the sulfonate detergent is a calcium alkylbnezene sulfonate.

60. A lubricating composition according to claim 54 wherein $R_1$ is H and $R_2$ is an alkyl group containing from 10 to 20 carbon atoms.

61. A lubricating composition according to claim 60 wherein the metal of the dithiophosphoric acid salt is zinc.

62. A lubricating composition according to claim 60 wherein $R_3$ and $R_4$ are both alkyl groups.

63. A lubricating composition according to claim 60 wherein the (B) component is a mixture of salts formed from one or more acids in which $R_3$ and $R_4$ are alkyl groups, and one or more acids in which $R_3$ and $R_4$ are aryl groups and alkylaryl groups, provided that the molar ratio of aryl to alkyl groups is in the range of 1:2 to 3:2.

64. A lubricating composition according to claim 60 wherein the sulfonate detergent is a calcium alkylbenzene sulfonate.

65. A lubricating composition according to claim 54 wherein $R_1$ and $R_2$ are both alkyl groups containing from 1 to 9 carbon atoms.

66. A lubricating composition according to claim 65 wherein the metal of the dithiophosphoric acid salt is zinc.

67. A lubricating composition according to claim 65 wherein $R_3$ and $R_4$ are both alkyl groups.

68. A lubricating composition according to claim 65 wherein the (B) component is a mixture of salts formed from one or more acids in which $R^3$ and $R_4$ are alkyl groups, and one or more acids in which $R^3$ and $R_4$ are aryl groups and alkylaryl groups, provided that the molar ratio of aryl to alkyl groups is in the range of 1:2 to 3:2.

69. A lubricating composition according to claim 65 wherein the sulfonate detergent is a calcium alkylbenzene sulfonate.

70. A lubricating composition according to claim 54 wherein $R_1$ is an alkyl group containing from 1 to 9 carbon atoms, and $R_2$ is an alkyl group containing from 10 to 20 carbon atoms.

71. A lubricating composition according to claim 70 wherein the metal of the dithiophosphoric acid salt is zinc.

72. A lubricating composition according to claim 70 wherein $R_3$ and $R_4$ are both alkyl groups.

73. A lubricating composition according to claim 70 wherein the (B) component is a mixture of salts formed from one or more acids in which $R_3$ and $R_4$ are alkyl groups, and one or more acids in which $R_3$ and $R_4$ are aryl groups and alkylaryl groups, provided that the molar ratio of aryl to alkyl groups is in the range of 1:2 to 3:2.

74. A lubricating composition according to claim 70 wherein the sulfonate detergent is an alkylbenzene sulfonate.

75. A lubricating composition according to claim 54 wherein $R_1$ and $R_2$ are both alkyl groups containing from 10 to 20 carbon atoms.

76. A lubricating composition according to claim 75 wherein the metal of the dithiophosphoric acid salt is zinc.

77. A lubricating composition according to claim 73 wherein $R_3$ and $R_4$ are both alkyl groups.

78. A lubricating composition according to claim 75 wherein the (B) component is a mixture of salts formed from one or more acids in which $R^3$ and $R_4$ are alkyl groups, and one or more acids in which $R^3$ and $R_4$ are aryl groups and alkylaryl groups, provided that the molar ratio of aryl to alkyl groups is in the range of 1:2 to 3:2.

79. A lubricating composition according to claim 75 wherein the sulfonate detergent is a calcium alkylbenzene sulfonate.

* * * * *